United States Patent [19]

Bastian et al.

[11] Patent Number: 4,826,117

[45] Date of Patent: May 2, 1989

[54] CLAMP ASSEMBLY AND METHOD FOR INSTALLING THE ASSEMBLY

[75] Inventors: John M. Bastian; Robert H. Brandt, both of Manitowoc, Wis.

[73] Assignee: Hamilton Industries, Inc., Two Rivers, Wis.

[21] Appl. No.: 144,251

[22] Filed: Jan. 15, 1988

[51] Int. Cl.[4] ..... A16M 13/00

[52] U.S. Cl. ..... 248/188.2; 248/501

[58] Field of Search ..... 248/188.2, 501, 502, 248/558, 677

[56] References Cited

U.S. PATENT DOCUMENTS

| | | | |
|---|---|---|---|
| 2,153,679 | 4/1939 | Rich | 248/501 X |
| 2,468,856 | 5/1949 | Alexander | 248/188.2 X |
| 2,877,875 | 3/1959 | Bolt | 248/188.2 X |
| 3,244,127 | 4/1966 | Evans | 248/188.2 X |
| 3,670,344 | 6/1972 | Boudreau | 248/188.2 X |
| 4,053,701 | 10/1977 | Ogilvie et al. | 312/223 X |

FOREIGN PATENT DOCUMENTS

| | | | |
|---|---|---|---|
| 391996 | 9/1965 | Switzerland | 248/188.2 |
| 191258 | 1/1923 | United Kingdom | 248/501 |

OTHER PUBLICATIONS

*MultiFlex by Hamilton,* Hamilton Industries, Inc., Two Rivers, Wisconsin 54241.

*Hamilton C-Frame Laboratory Systems,* Hamilton Industries, Inc., Two Rivers, Wisconsin 54241.

*Primary Examiner*—J. Franklin Foss

*Assistant Examiner*—David L. Talbott

*Attorney, Agent, or Firm*—Tilton, Fallon, Lungmus & Chestnut

[57] ABSTRACT

An improved clamp assembly is provided which includes a main body member, at least one locking plate and connecting devices for anchoring the main body member to a supporting surface and for securing the locking plate and the main body member to the structural member. The method for installing this assembly includes: loosely connecting the structural member, the main body member and the locking plate together; adjusting the position of the structural member relative to the main body member; securing the main body member with the structural member using the connecting devices and the locking plates; using the main body member as a template to form openings in the supporting surface; and securing the main body member to the supporting surface using the connecting devices.

7 Claims, 2 Drawing Sheets

211
M

C
M
11
F

M
M
111

CLAMP ASSEMBLY AND METHOD FOR INSTALLING THE ASSEMBLY

BACKGROUND OF INVENTION

1. Field Of The Invention

The present invention relates generally to a clamp assembly and a method for installing the assembly. Specifically, this invention relates to a clamp assembly which secures structural members to a supporting surface at a precise, predetermined position, and a method for installing the assembly to the supporting surface.

2. Description Of The Prior Art

A wide variety of furniture, fixtures, partition systems and structural support members require anchoring to a supporting surface. In a number of applications, the securing device must generally hold the secured member in a predetermined location and must withstand substantial forces which act on the member. For example, in many laboratory applications, the securing device must maintain the fixture or structural member in a precise, predetermined position and must minimize movement of the member. In such applications, inadvertent and unpredictable movements may disrupt experiments and cause a number of other harmful results.

The specific features required for the securing devices in such applications include the following: First, the device must allow quick and easy installation. Second, the device must allow the user to adjust the position of the structural member relative to the device and the supporting surface. Thus, the device can avoid any non-uniformities in the supporting surface and can place the structural member at a precise angle to the supporting surface. Third, the device must secure the structural member against any undesired external forces including seismic as well as gravity loading. Finally, the device must allow quick and easy disassembly.

The prior art includes a wide variety of clamping or securing devices. Some of these devices allow the user to adjust the position of the member which they secure after the user has placed the device on the supporting surface. However, these devices allow limited adjustment, and they do not provide the reliability and the assurance required against inadvertent movement of the secured member. Other prior devices provide reliable connections; however, they do not provide the adjustability required.

The clamp assembly of the present invention fulfills the requirements outlined above. In addition, it overcomes the disadvantages of the prior clamping devices. It allows quick and easy anchoring of a fixture or structural member to a supporting surface and precise adjustment of the member to the desired location. It also provides a secure and reliable clamping force to maintain the support member in the desired location.

SUMMARY OF THE INVENTION

It is a general object of the present invention to provide an improved clamp assembly. Specifically, it is an object of this invention to provide a clamp assembly which provides quick and easy anchoring of a fixture or structural member; allows adjustment of the member to a precise location; and maintains the member at the desired location, preventing external loads and bending moments from moving the member from the predetermined or desired position.

It is another object of the present invention to provide a method for installing the clamp assembly where it will maintain the secured structural member in the precise, predetermined location.

Other objects, advantages and features of the present invention will become apparent upon reading the following detailed description and appended claims and upon reference to the accompanying drawings.

In accordance with one embodiment of the present invention, a clamp assembly which achieves the foregoing objects is made of high strength metal or any other material of sufficient strength and rigidity; and it includes a main body member. Generally, this main body member has an L-shaped cross-section; and it includes a footing segment which engages a floor or other supporting surface, a stem segment disposed at a right angle to the footing segment and cross bracing which adds strength and rigidity to the main body member and maintains the stem and footing segments at a right angle.

The footing segment is flat and plate-like. It has openings through which bolts or other similar connecting devices extend to anchor the main body member to a supporting surface.

The stem segment is also flat and plate-like; and it has a thickness which is preferably less than the diameter of the bolts which connect the stem segment to a structural member and, in any event, no greater than twice the diameter of such bolts. This feature precludes bending of the bolts when a large force or bending moment acts on the structural member.

The stem segment engages a vertical structural member or fixture on one side or face and at least one locking plate on the opposite side. A portion of this second or opposite surface of the stem segment includes a pattern of serrations. In addition, the stem segment has a plurality of elongate openings. These openings and the serrations provide adjustment and locking functions described below. Finally, the stem segment has at least one enlarged opening through which utility conduits may extend.

In the preferred embodiment, the clamp assembly includes two locking plates which secure the structural member or fixture to the main body member of the clamp assembly. One face of each locking plate has serrations formed into it; and it engages the serrated face of the stem segment of the main body member to secure the structural member to the main body member of the clamp assembly. Alternatively, the clamp assembly may have only one locking plate.

The clamping assembly also includes a plurality of nut and bolt assemblies. Each one of the bolts extends through a separate opening in the structural member, an elongate opening in the stem segment of the main body member, and an opening in one of the locking plates. The openings in the structural member and the locking plates do not allow substantial play between the bolt and the walls of the opening. However, the elongate openings in the stem segment of the main body member have a width substantially greater than the diameter of the bolts; and they allow substantial play between the bolt and the stem segment to allow a user to adjust the position of the structural member relative to the main body member. Accordingly, the user may adjust the angle of the structural member to the supporting surface and avoid any non-uniformities in the supporting surface.

To install the clamp assembly of the present invention, the user places the bolts through the openings in the structural member, the elongate openings in the stem segment of the main body member, and the openings in the locking plates. After loosely attaching nuts to the threaded shanks of the bolts, the user then adjusts the relative position between the main body member and the structural member to maintain the structural member in the precise vertical position or orientation into which the user adjusted it. Once the user has made such an adjustment, preferably by means of a threaded floor-engaging leveling glide or shoe, the user then tightens the nuts of the nut and bolt assemblies and thereby clamps the structural member to the main body member. Finally, using the footing segment of the main body member as a template, the user drills openings in the supporting surface through the openings in the footing segment and anchors the floor plate to the supporting surface.

BRIEF DESCRIPTION OF THE DRAWINGS

For a more complete understanding of this invention, one should now refer to the embodiment illustrated in greater detail in the accompanying drawings and described below by way of an example of the invention. In the drawings.

While the drawings and the text describe the invention with a preferred embodiment, one will understand, of course, that the invention is not limited to this embodiment. Furthermore, one should understand that the drawings are not necessarily to scale.

DETAILED DESCRIPTION OF THE DRAWINGS AND A PREFERRED EMBODIMENT

Figure 1:
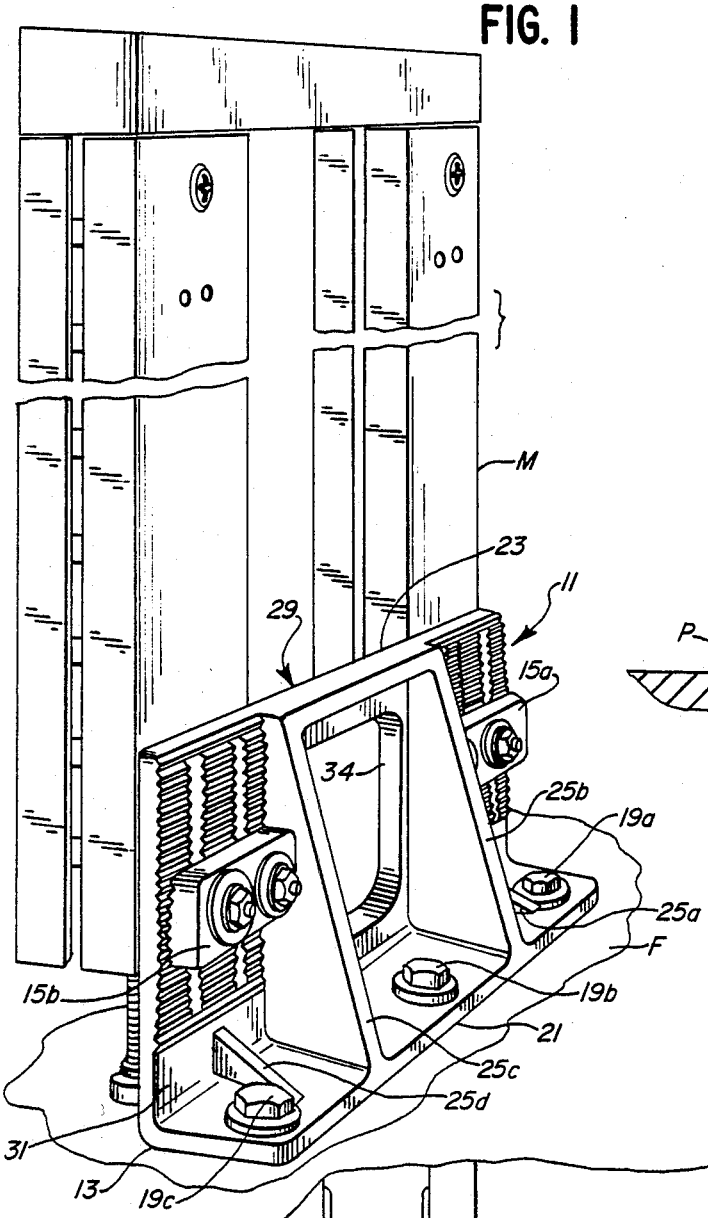
FIG. 1 is a perspective view of a preferred embodiment of the clamp assembly of the present invention, showing the clamp assembly in place at the bottom of a vertical support or riser of a laboratory fixture where it secures the riser to the floor or supporting surface in the laboratory.
Figure 2:
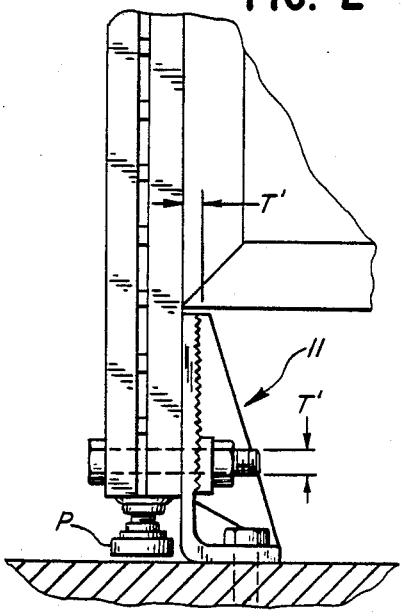
FIG. 2 is a side elevational view of the clamp assembly and riser arrangement of FIG. 1.

Turning now to the drawing, FIG. 1 shows the preferred embodiment of an improved clamp assembly generally at 11 below a vertical support or riser M which it secures to a supporting surface or floor F. The clamp assembly 11 is made of high strength metal or any other material of high strength and rigidity. It generally includes a main body member 13; two locking plates 15*a* and 15*b;* four bolt and nut assemblies 17*a*–17*d* for securing the main body member and the riser M together; and bolts 19*a*–19*c* for securing the main body member to the supporting surface F.

The main body member 13 of the clamp assembly 11 has an L-shaped cross section. It includes a footing segment 21 for engaging the supporting surface F, a stem segment 23 for engaging the riser M, and cross bracing 25*a*–25*d*. The stem segment lies perpendicularly to the footing segment; and the cross bracing lies between them, adding rigidity and strength to the main body member and maintaining the segments 21 and 23 at a right angle to each other.

Figure 3:
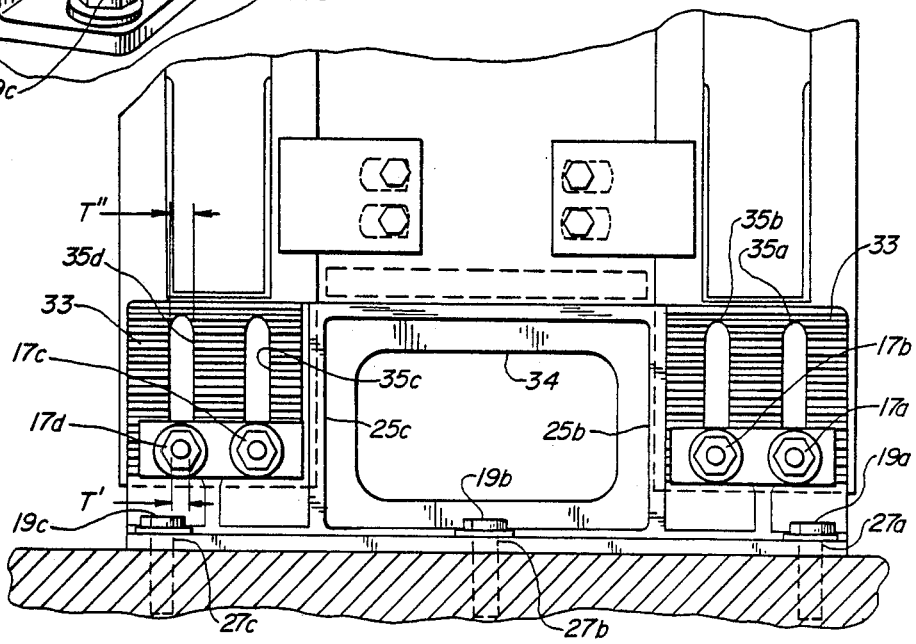
FIG. 3 is a front elevational view of the clamp assembly and riser arrangement of FIG. 1.

The footing segment 21 of the main body member 13 includes three openings 27*a*–27*c* (See FIG. 3) through which bolts 19*a*–19*c* extend to secure the main body member to the supporting surface F. Although the preferred embodiment includes three anchoring bolts, alternative embodiments may include a greater or fewer number of bolts.

The stem segment 23 of the main body member 13 includes a first surface 29 which engages the structural support member M and a second opposite surface 31 which includes a serrated portion 33 and which engages the locking plates 15*a* and 15*b* in a manner described more fully below. This segment 23 includes an opening 34 for allowing utility conduits and similar devices to extend through the main body member 13. It also includes vertically elongate openings 35*a*–35*d* through which the bolts of the nut and bolt assemblies 17*a*–17*d* extend. These openings have a width which allows substantial lateral play between the bolt and the wall of the opening. Consequently, a user may freely adjust the tilt of the riser M once he or she has placed the main body member 13 on the supporting surface F.

The stem segment 23 preferably has a thickness less than the diameter of the bolts of the nut and bolt assemblies 17*a*–17*d* and, in any event, no greater than twice such diameter. This size relationship is important because it limits the exposure of the bolts to bending forces when a large bending moment, such as the one created by a large (and heavy) lab furniture component C secured to the riser M (See FIG. 4), acts on the assembly 11. In effect, such size relation insures that shear forces act on the bolts rather than bending and tensioning forces that might result in deformation (and maybe failure) of the bolts, and possible shifting of the riser M out of its vertical position of adjustment.

The nut and bolt assemblies 17*a* and 17*b* cooperate with the locking plate 15*a;* and the nut and bolt assemblies 17*c* and 17*d* cooperate with the locking plate 15*b* to secure the main body member 13 to the riser M and preclude relative movement between them. Each locking plate includes a first surface serrated with a pattern similar to the pattern of the face 31 of the stem segment 23 and a second, opposite surface which the nuts of the nut and bolt assemblies engage. Although the preferred embodiment has serrated surfaces on the locking plates and stem segment, alternative embodiments may use any other pattern or surface irregularity to provide locking engagement between these two members. In addition, the locking plates also include a pair of openings (not shown) sized to receive the two respective bolts of the nut and bolt assemblies 17*a*–17*d* with minimal play between the bolts and the locking plates. Similarly, the structural member M has corresponding openings (not shown) through which the bolts of the bolt and nut assemblies 17*a*–17*d* extend.

Figures 4, 5, 6:
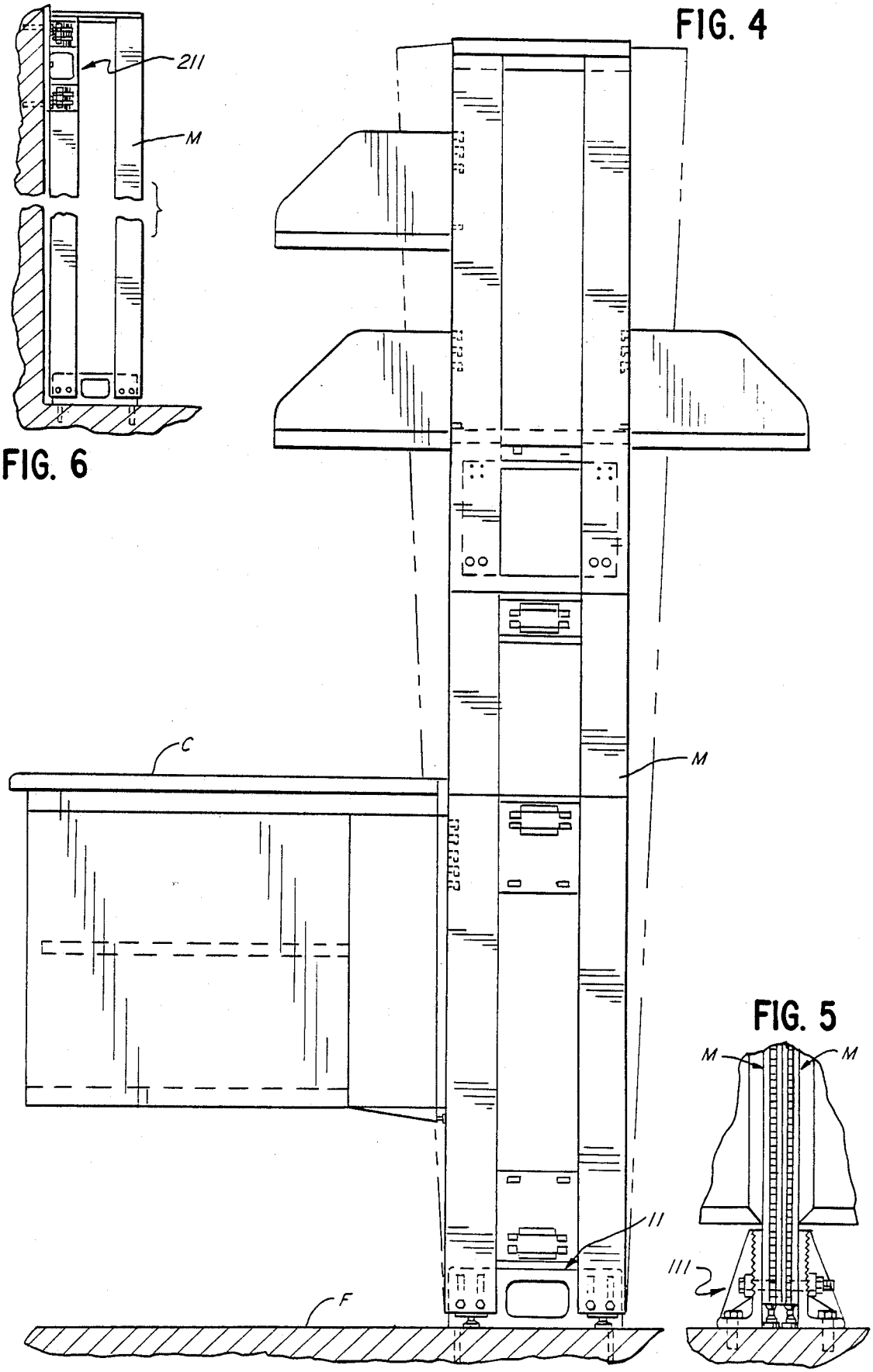
FIG. 4 is a side elevational view of the floor clamp assembly and riser arrangement showing lab furniture secured to the riser.
FIG. 5 is a side elevational view of an alternative floor clamp and riser arrangement in which the floor clamp includes a main body member and a set of locking plates disposed on each side of a riser.
FIG. 6 is a front elevational view of another alternative clamp assembly and riser arrangement including a clamp assembly for securing the risers to a horizontal surface and a clamp assembly securing the risers to a vertical surface.

To install the clamp assembly and secure the structural member M to the supporting surface F, the user places the bolts of the nut and bolt assemblies 17*a*–17*d* through the corresponding openings in the structural member M, through the openings 35*a*–35*d* in the stem segment, and through the openings in the locking plates 15*a* and 15*b*. The user then threads the nuts of each nut and bolt assembly to the bolts but does not tighten the nuts fully. Then, by adjusting the threaded glides or shoes P with respect to the floor surface F, the user shifts riser M into precise vertical orientation as indicated in FIG. 4. The substantial play between the bolts and the elongate openings 35*a*–35*d* allows the user to tilt the riser or structural member into the desired orientation and accommodate any non-uniformity in the supporting surface.

Once the user has placed the riser or structural member in the desired position (usually a precisely vertical position), he or she tightens the nuts of the nut and bolt assemblies 17*a*–17*d* to secure the locking plates together against the main body member and to fix the clamp assembly to the riser. The serrations of the locking plate cooperate with the serrations in the main body member to prevent any movement of the riser M in a direction parallel to the longitudinal axes of the elongate openings 35*a*–35*d*.

Finally, using the main body member as a template, and specifically the openings 27*a*–27*c*, the user places the clamp assembly and riser M in the desired location on the supporting surface F and forms openings in the supporting surface into which the user then places the bolts 19*a*–19*d* to anchor the clamp assembly and the structural member to the supporting surface F.

FIG. 5 shows a modification to the preferred embodiment generally at 111. In this alternative, the clamp assembly 111 anchors two structural members M. It includes two main body members with a set of locking plates for each main body member and nut and bolt assemblies which extend through suitable openings in the locking plates, the main body members and the two structural members M to secure the members M to the supporting surface. A further alternative includes using a clamp assembly 211 to secure the member M to a vertical surface (See FIG. 6).

Thus, the applicants have provided a clamp assembly of simple yet effective construction. This construction secures fixtures r structural members to a supporting surface and prevents inadvertent movement of those members. While the applicants have shown several embodiments of the invention, one will understand, of course, that the invention is not limited to these embodiments since those skilled in the art to which the invention pertains may make modifications or other embodiments of the principles of this invention, particularly upon considering the foregoing teaching.. For example, one skilled in the art may modify the main body member to include only two elongate openings in the stem segment of the main body member and only one locking plate. Therefore, by the appended claims, the applicants intend to cover any such modifications and other embodiments as incorporate those features which constitute the essential features of this invention.

What is claimed is:

1. A floor plate assembly for securing a structural member to a supporting surface, said assembly comprising: a main body member for engaging the supporting surface and the structural member, a first securing means for securing said main body member to said supporting surface, and a second securing means for connecting said main body member and said structural member together at a first and second location, said second securing means permitting relative sliding and pivotal adjustment between said main body member and said structural support member at said first and second locations to allow adjustment of the distance between the structural member and the supporting surface at one location independent of the adjustment at the other location so that a user may vary the distance between the structural member and the supporting surface and the tilt of the structural member relative to the supporting surface, said second securing means locking said main body member and said structural support member together after said adjustment.

2. A clamp assembly for securing a structural member to a supporting surface, said assembly comprising: a main body member for engaging the supporting surface and the structural member, a first securing means for securing said main body member to said supporting surface, and second securing means for connecting said main body member simultaneously and said structural member together at a first location and a second position location allowing relative sliding and pivotal adjustment between said main body member and said structural member at said first and second locations, and then locking said main body member and said structural member together said first location being spaced a predetermined distance from said second location along said support surface, said second securing means including locking means disposed at said first and second locations for engaging said main body member and locking said main body member and said structural support member together.

3. The clamp assembly of claim 2 wherein said main body member includes at least one opening for allowing utility conduits and the like to extend through the main body member.

4. The clamp assembly of claim 2, wherein said main body member and said locking plate means includes serrated surfaces which engage each other to lock the main body member and the locking plate means together.

5. A method for installing a clamp assembly and securing a structural member to a supporting surface, said clamp assembly including a main body member having a plurality of openings, means for connecting said main body member and said structural member together at a first and second location, allowing relative sliding and pivotal adjustment between said main body member and said structural member at said first and second locations and locking said main body member and said structural member together after the adjustment, and second securing means for anchoring said main body member to the supporting surface, said method comprising the steps of: connecting said main body member and said structural member together; placing said main body member on said supporting surface; adjusting the distance between said supporting surface and the structural member at said first location; adjusting the distance between the supporting surface and the structural member at said second location, locking said body member and said structural member together, using the main body member as a template to form openings in the supporting surface through the openings in said main body member, anchoring said main body member to said supporting surface.

6. A clamp assembly for securing a structural member to a supporting surface, said assembly comprising: a main body member having a first portion for engaging said supporting surface and a second portion for engaging said structural support member; a first securing means for securing said first portion of said main body member to said supporting surface; a second securing means disposed at one end of said second portion of said main body member for connecting said main body member and said structural member together; and a third securing means disposed at the opposite end of said portion of said main body member for connecting said main body member and said structural member together; said second and third securing means allowing relative sliding and pivotal adjustment between said main body member and said structural member to allow adjustment of the relative position between said main body member and said structural member and then locking said main body member and said structural member together after adjustment.

7. The claimed assembly of claim 6, wherein said first and second securing means each include at least one nut and bolt assembly and a locking plate.

* * * * *

UNITED STATES PATENT AND TRADEMARK OFFICE

CERTIFICATE OF CORRECTION

PATENT NO. : 4,826,117

DATED : May 2, 1989

INVENTOR(S) : Bastian, John M.; Brandt, Robert H.

It is certified that error appears in the above-identified patent and that said Letters Patent is hereby corrected as shown below:

Column 3, line 37, cancel "riser" and substitute "risers"
Column 5, line 41, cancel "r" and substitute "or"
Column 6, line 17, delete "position"
Column 6, line 18, before "allowing" insert ","
Column 6, line 22, after "together" insert ","
Column 6, line 56, before "body" insert "main".

Signed and Sealed this

Twenty-seventh Day of March, 1990

*Attest:*

JEFFREY M. SAMUELS

*Attesting Officer*

*Acting Commissioner of Patents and Trademarks*